US008011949B2

(12) United States Patent
Foratier et al.

(10) Patent No.: US 8,011,949 B2
(45) Date of Patent: Sep. 6, 2011

(54) CONNECTOR WITH SIMPLIFIED MOUNTING FOR A MULTIPLE CONDUCTOR CABLE

(75) Inventors: Nathalie Foratier, Saint Antoine l'Abbaye (FR); Jean-Marc Jaouen, La Sône (FR); Didier Revol, Chatte (FR); Vincent Laroche, Saint-Marcellin (FR)

(73) Assignee: LeGrand France and LeGrand SNC (FR)

( * ) Notice: Subject to any disclaimer, the term of this patent is extended or adjusted under 35 U.S.C. 154(b) by 0 days.

(21) Appl. No.: 12/522,621

(22) PCT Filed: Jan. 10, 2008

(86) PCT No.: PCT/FR2008/000031

§ 371 (c)(1),
(2), (4) Date: Jan. 28, 2010

(87) PCT Pub. No.: WO2008/099093

PCT Pub. Date: Aug. 21, 2008

(65) Prior Publication Data

US 2010/0159735 A1 Jun. 24, 2010

(30) Foreign Application Priority Data

Jan. 12, 2007 (FR) ..... 07 000240

(51) Int. Cl.
*H01R 11/20* (2006.01)

(52) U.S. Cl. ..... 439/404; 439/417

(58) Field of Classification Search ..... 439/404, 439/417, 395, 400, 405, 406, 407, 408, 409, 439/410

See application file for complete search history.

(56) References Cited

U.S. PATENT DOCUMENTS

| | | | | |
|---|---|---|---|---|
| 5,752,849 | A | 5/1998 | Orlando | 439/412 |
| 5,947,761 | A | 9/1999 | Pepe | 439/409 |
| 2005/0106946 | A1 | 5/2005 | Doorhy et al. | 439/676 |
| 2005/0250372 | A1 * | 11/2005 | Doorhy et al. | 439/404 |
| 2006/0246780 | A1 | 11/2006 | Bert et al. | 439/608 |

FOREIGN PATENT DOCUMENTS

| | | |
|---|---|---|
| FR | 2 815 775 | 4/2002 |
| WO | WO 01/50548 A1 | 7/2001 |

OTHER PUBLICATIONS

International Search Report, application No. PCT/FR2008/000031 dated Sep. 23, 2008.
Written Opinion of the International Searching Authority, application No. PCT/FR2008/000031.

* cited by examiner

*Primary Examiner* — Ross Gushi
(74) *Attorney, Agent, or Firm* — Seyfarth Shaw LLP; Richard P. Gilly

(57) ABSTRACT

The invention relates to a connector to be mounted on a cable (K) with a plurality of insulated connectors (C), and including a comb (1), a connection terminal block (2) and assembling members (4). According to the invention, the comb (1) includes self-stripping contacts (3) associated with notches (11) for simultaneously introducing each insulated conductor (C) of the cable into a notch (11) and for engaging it into the stripping contact (3) associated with said notch.

8 Claims, 8 Drawing Sheets

CONNECTOR WITH SIMPLIFIED MOUNTING FOR A MULTIPLE CONDUCTOR CABLE

CROSS-REFERENCE TO RELATED APPLICATIONS

This application is a 371 filing of International application no. PCT/FR2008/000031 filed Jan. 10, 2008.

FIELD

The invention relates, generally, to the field of connections, and in particularly that of connection accessories for computer applications.

More specifically, the invention relates to a connector to be mounted on a multiple conductor cable and comprising at least one comb, a connection terminal block, self-stripping electric contacts and assembling means, the comb being passed through by a central duct to allow the cable to pass along a longitudinal axis and displaying, on a first front face, notches arranged about the central duct and wherein each is designed to hold a corresponding insulated conductor of the cable, the terminal block having a plurality of metal contacts, being suitable for receiving a multiple conductor detachable plug, and comprising a second front face which, in the mounted configuration of the connector, is adjacent to the first front face, each of the self-stripping electric contacts being suitable for receiving and stripping, during a connector mounting phase, a corresponding insulation conductor of the cable by means of a relative movement of said conductor and said contact, and the assembling means providing, in the mounted configuration of the connector, a reversible attachment of the comb and the terminal block on each other.

A connector of this type is particularly known to those skilled in the art through the patent U.S. Pat. No. 5,752,849.

Despite the benefit thereof, the connector described in this prior patent is relatively difficult to use, the prevent invention being specifically intended to propose a connector which is much easier and quicker to use.

SUMMARY

To this end, the connector according to the invention, also complying with the generic definition given in the above preamble, is essentially characterized in that each self-stripping contact is comprised by the first front face of the comb and associated with a corresponding notch to simultaneously enable the introduction of each insulated conductor into a notch and the engagement thereof in the self-stripping contact associated with said notch, and in that, at least in the mounted configuration of the connector, each self-stripping contact is connected electrically to a corresponding metal contact of the terminal block.

If the comb and the terminal block are detachable with respect to each other, it may be envisaged for the comb to comprise a first set of transmission contacts each of which is connected to a corresponding self-stripping contact, for the terminal block to comprise a second set of transmission contacts each of which is connected to a corresponding metal contact of said terminal block, and, in the mounted configuration of the connector, for each transmission contact of the first set to be in electric contact with a corresponding transmission contact of the second set.

If the comb and the terminal strip do not need to be separated from each other, the connectors according to the invention may comprise a flexible multiple conductor ribbon cable connecting the self-stripping contacts comprised by the comb and the metal contacts comprised by the terminal block individually.

In any case, the second front face of the terminal block may comprise a plurality of pins each of which, during the connector mounting phase, moves an insulated conductor to the rear of the corresponding notch, simultaneously triggering said relative movement of said conductor with respect to the self-stripping contact associated with said notch.

The comb and the terminal block may advantageously have cylindrical and complementary respective guiding surfaces, facing each other, and making it possible, by means of relative sliding, to guide the comb and the terminal block with respect to each other in the connector mounting phase.

Preferentially, the comb and the terminal block then comprise, on the side of the guiding surfaces, a first pair of complementary relief surfaces engaging with each other at the end of the connector assembly phase.

The comb and the terminal block also advantageously comprise, at a distance from the first pair of complementary relief surfaces, a second pair of respective complementary relief surfaces locking elastically with each other in a reversible manner at the end of the connector mounting phase.

The axial housing serving as a receptacle for the detachable plug may be comprised by the terminal block opposite the second front face.

At least one of the members consisting of the comb and the terminal block, and optionally each of said members, may also be produced, at least partially, by molding a thermoplastic material.

The invention is particularly suitable for producing a connector complying with the standard ISO IEC 11 801.

BRIEF DESCRIPTION OF THE DRAWINGS

Other features and advantages of the invention will emerge clearly from the description hereinafter, which is given as an indication and is in no way limitative, with reference to the appended figures, wherein.

DETAILED DESCRIPTION

Figure 1:
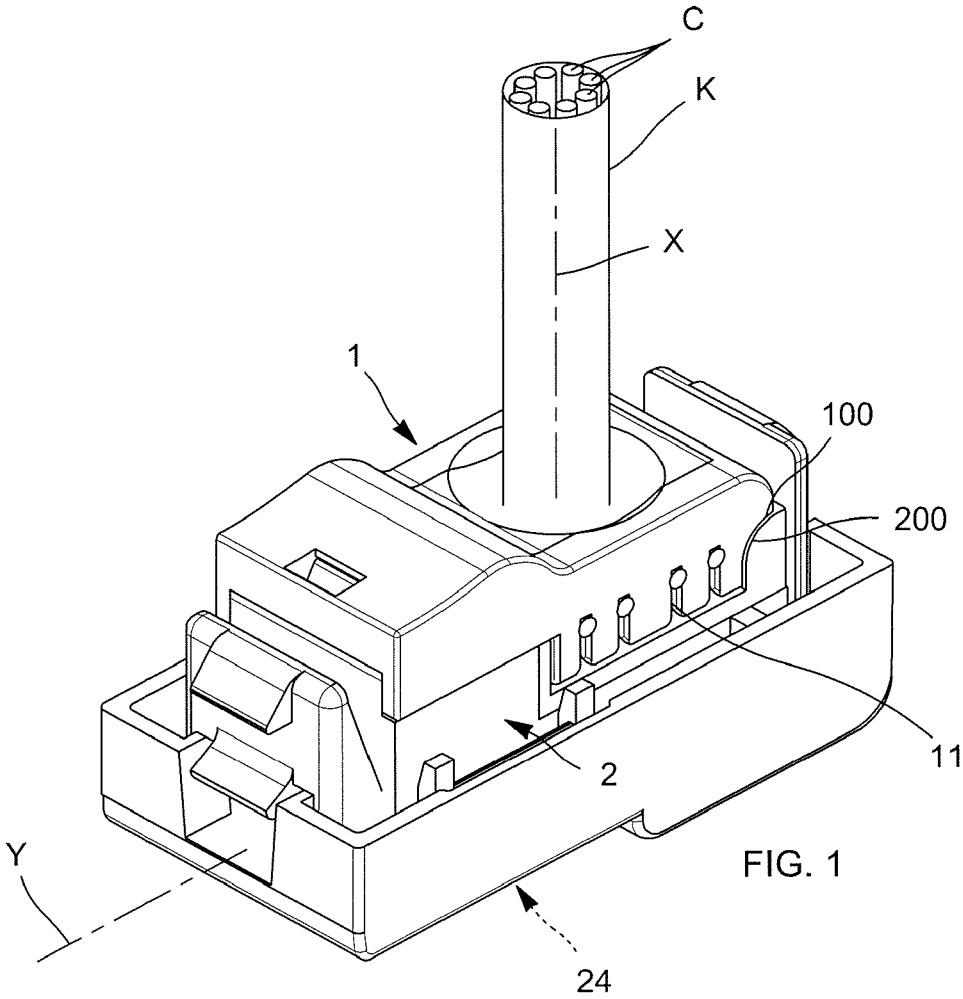
FIG. 1 is perspective view of a connector according to a first embodiment of the invention, represented in a mounted configuration.

As mentioned above, the invention relates to a connector to be mounted in a multiple conductor cable K, complying, for example with the standard ISO/IEC 11 801, said connector comprising at least one optionally detachable comb 1, a connection terminal block 2, self-stripping contacts 3, and assembling means 4.

The comb 1 is passed through by a central duct 5 (FIG. 6) to allow a cable K to pass along a longitudinal axis X of the connector.

Said comb comprises, on a front face 10, notches 11 arranged about the central duct 5, each notch 11 being designed to hold a corresponding insulated conductor C of the cable K.

Figure 2:
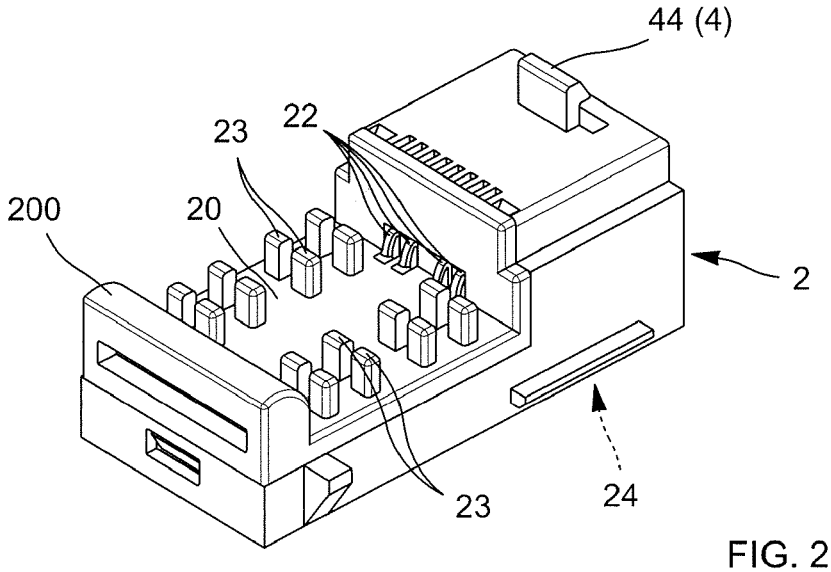
FIG. 2 is a perspective view of the terminal block used in the connector in FIG. 1 and illustrated after a 180 degree rotation about the axis X in FIG. 1.
Figure 3:
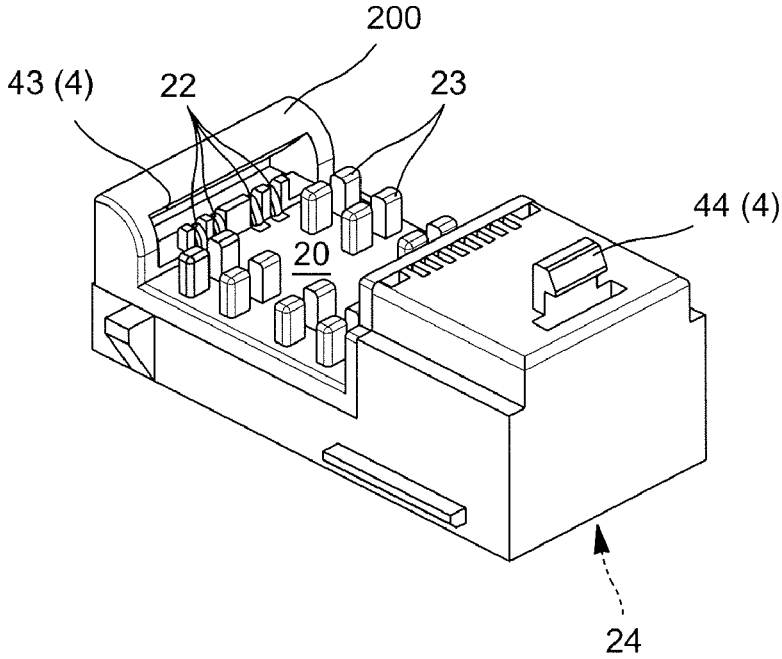
FIG. 3 is a perspective view of the terminal block used in the connector in FIG. 1 and illustrated after a 90 degree rotation about the axis X in FIG. 1.

The terminal block 2 is suitable for receiving a multiple conductor detachable plug and comprises, for example, for this purpose, an axial housing 24 serving as a receptacle for such a plug and the location of which is specified in FIGS. 1 to 3.

Said terminal block 2 comprises, opposite the axial housing 24, a front face 20 which, in the mounted configuration of the connector, is arranged facing the front face 10 of the comb 1 and immediately adjacent to said face 10.

Each of the self-stripping electric contacts 3 is suitable for receiving a corresponding insulated conductor C of the cable K.

More specifically, each of the contacts 3 comprises, in a known manner, a pair of metal blades intended to strip, during the connector mounting phase, the insulated conductor C corresponding thereto, by means of a relative movement of said contact 3 and of said insulated conductor C.

The assembling means 4 are intended to provided, in the mounted configuration of the connector, a reversible attachment of the comb 1 and the terminal block 2 on each other.

According to the invention, each of the self-stripping contacts 3 is on the first front face 10 of the comb 1.

In addition, each of these contacts 3 is associated with a corresponding notch 11 to simultaneously enable the introduction of each insulated conductor C in the notch 11 corresponding to said conductor, and the engagement of said conductor in the self-stripping contact 3 associated with said notch.

Furthermore, each self-stripping contact 3, at least in the mounted configuration of the connector, is electrically connected with a corresponding metal contact 21 of the terminal block 2.

In the first embodiment of the invention, which is illustrated in FIGS. 1 to 11, the comb 1 and the terminal block 2 are devised to be completely detachable from each other.

In this case, the electrical connection between the contacts 3 and the metal contacts 21 may be provided via a first set of transmission contacts 12 comprised by the comb 1 (FIG. 4) and a second set of transmission contacts 22 comprised by the terminal block 2 (FIGS. 2 and 3).

More specifically, each of the transmission contacts 12 is then connected to a corresponding self-stripping contact 3 of the comb 1, each of the transmission contacts 22 is connected to a corresponding metal contact 21 of the terminal block 2, and each transmission contact 12 of the comb is in electric contact with a corresponding transmission contact 22 of the terminal block in the mounted configuration of the connector.

Figure 8:
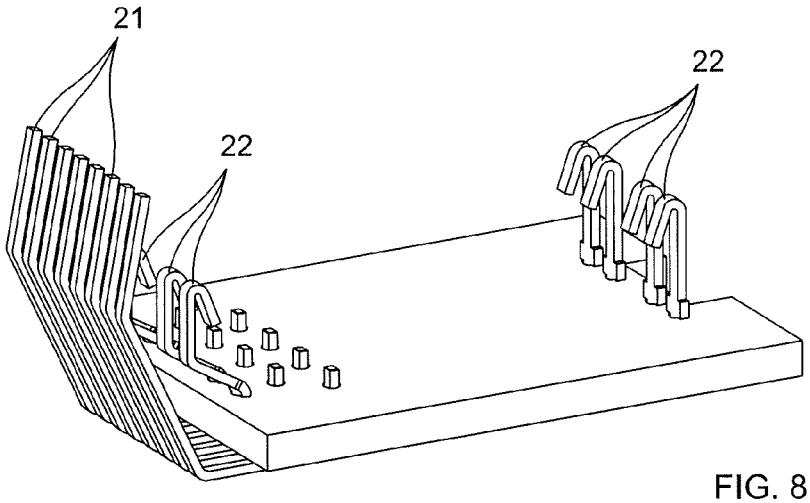
FIG. 8 is a large-scale perspective view of a subassembly of the terminal block used in the connector in FIG. 1.

As illustrated in FIGS. 2, 3 and 8, the transmission contacts 22 of the terminal block 2 are for example folded back in the form of a hair-pin to display a specific transverse elasticity to optimize the quality of the electrical contact between the transmission contacts 12 and the transmission contacts 22.

Figure 12:
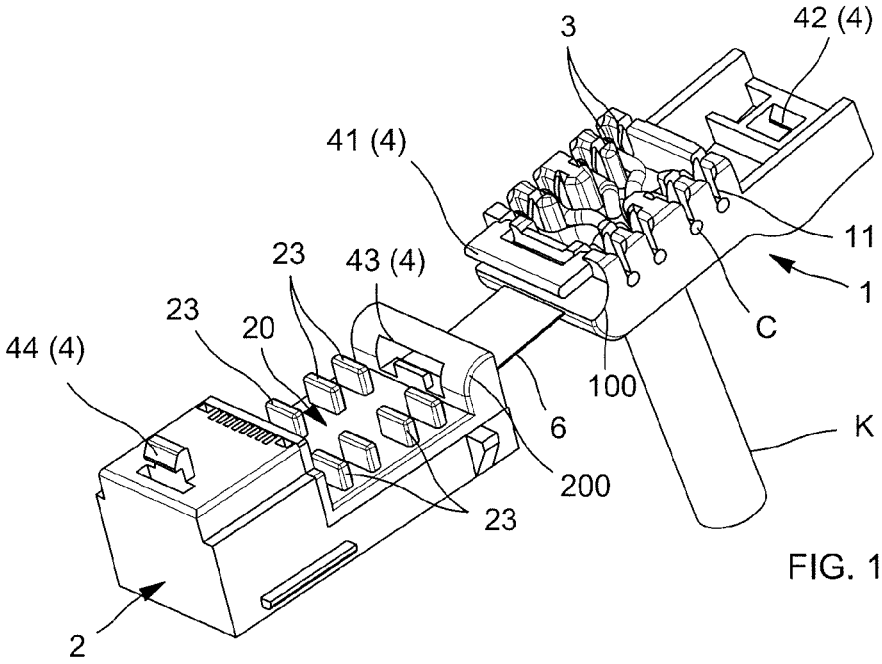
FIG. 12 is a perspective view of a connector according to a second embodiment of the invention, represented in the assembly phase before the comb and terminal block are brought closer together.
Figure 13:
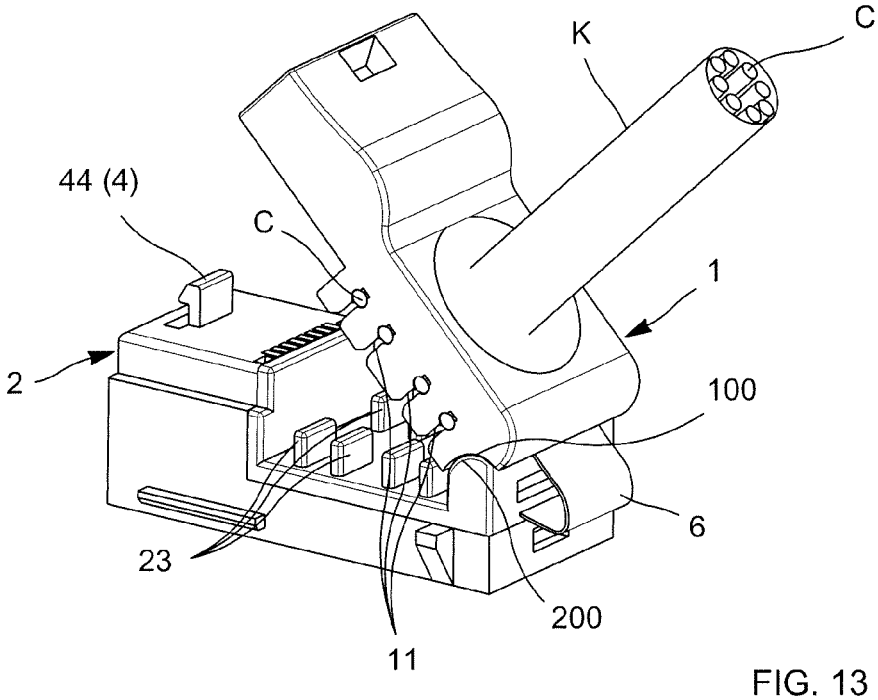
FIG. 13 is a perspective view of a connector according to the second embodiment of the invention, represented in the mounting phase after the comb and terminal block have been brought closer together.

In the second embodiment of the invention, which is illustrated in FIGS. 12 and 13, the connector comprises a flexible multiple conductor ribbon cable 6 connecting the self-stripping contacts 3 comprised by the comb 1 and the metal contacts 21 comprised by the terminal block 2 individually, such that, in this embodiment, the comb 1 and the terminal block 2 remain connected to each other via said ribbon cable 6.

Irrespective of the embodiment envisaged, it is advantageous to envisage that the front face 20 of the terminal block 2 comprises a plurality of pins 23 each of which is arranged facing a notch 11.

Said pins may serve two functions, according to the manner in which the connector is mounted.

More specifically, if each of insulated conductors C is, during the mounting phase, individually inserted to the rear of a notch 11 and corresponding self-stripping contact 3, each of said pins 23 only serves to hold at the rear of the corresponding notch the insulated conductor C inserted into said notch and stripped in the corresponding contact 3.

It is nevertheless possible to limit the procedures performed at the start of the mounting phase by simply placing each conductor C facing a corresponding notch 11 without inserting said conductor therein.

In this case, each pin 23 may then serve, subsequently in the mounting phase devoted to assembling the comb 1 and the terminal block 2, the function consisting of moving the corresponding insulated conductor C to the rear of the associated notch 11, by simply triggering the relative movement, with respect to the corresponding self-stripping contact 3, of said conductor C which is thus automatically stripped.

The comb 1 and the terminal block 2 may also have cylindrical complementary respective guiding surfaces 100 and 200, arranged facing each other.

These guiding surfaces, which are advantageously of the same curvature to be able to slide on each other, make it possible to guide the comb 1 and the terminal block 2 with respect to each other at the time of assembly of the connector, which is performed at the end of the mounting phase.

The comb 1 and the terminal block 2 respectively have, on the side of the guiding surfaces 100 and 200, complementary retaining relief surfaces 41 and 43, for example consisting of a tab 41 and a housing 43, respectively.

Figure 9:
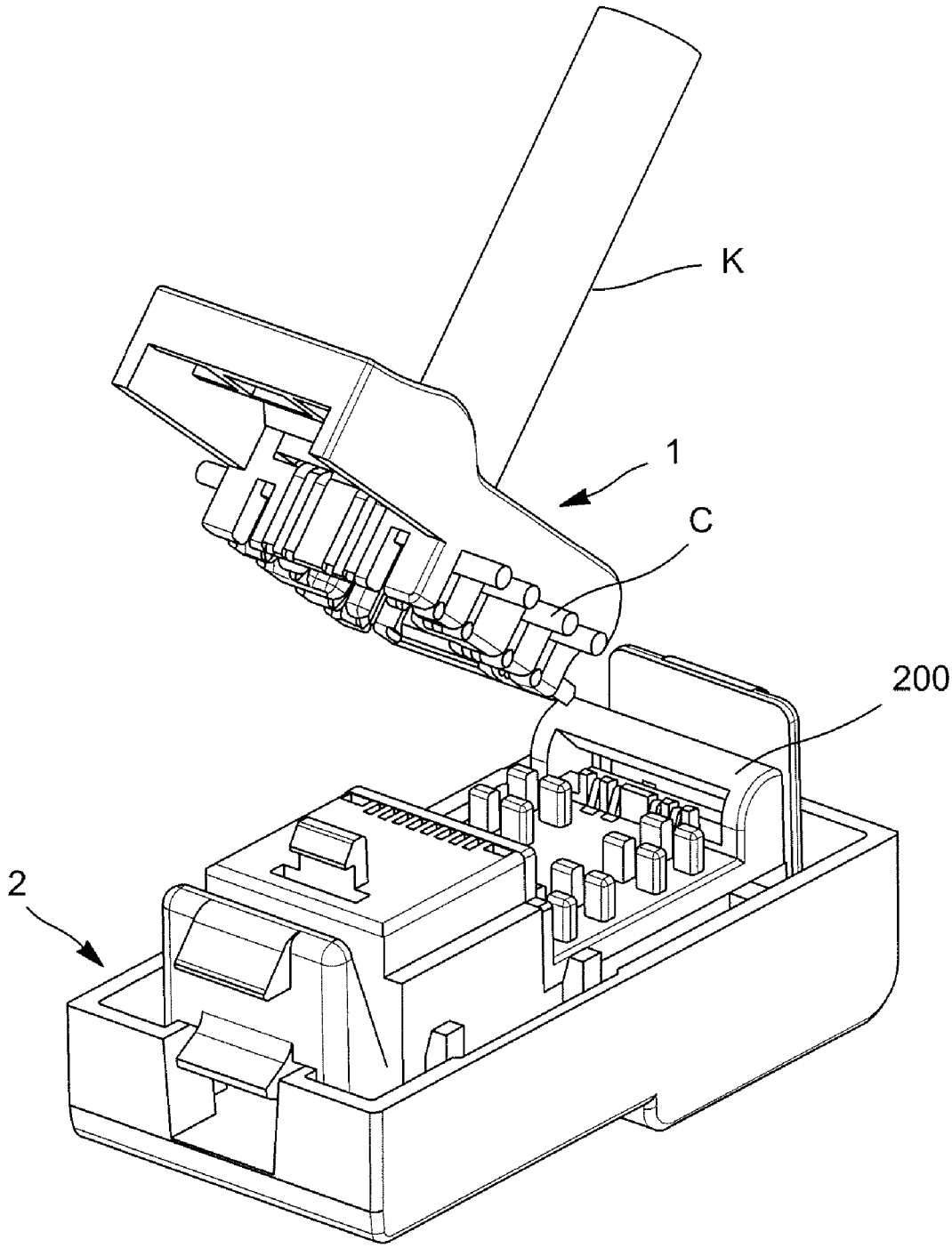
FIG. 9 is a perspective view of a connector according to the first embodiment of the invention, represented in the mounting phase, the comb and the terminal block being brought closer together.
Figure 10:
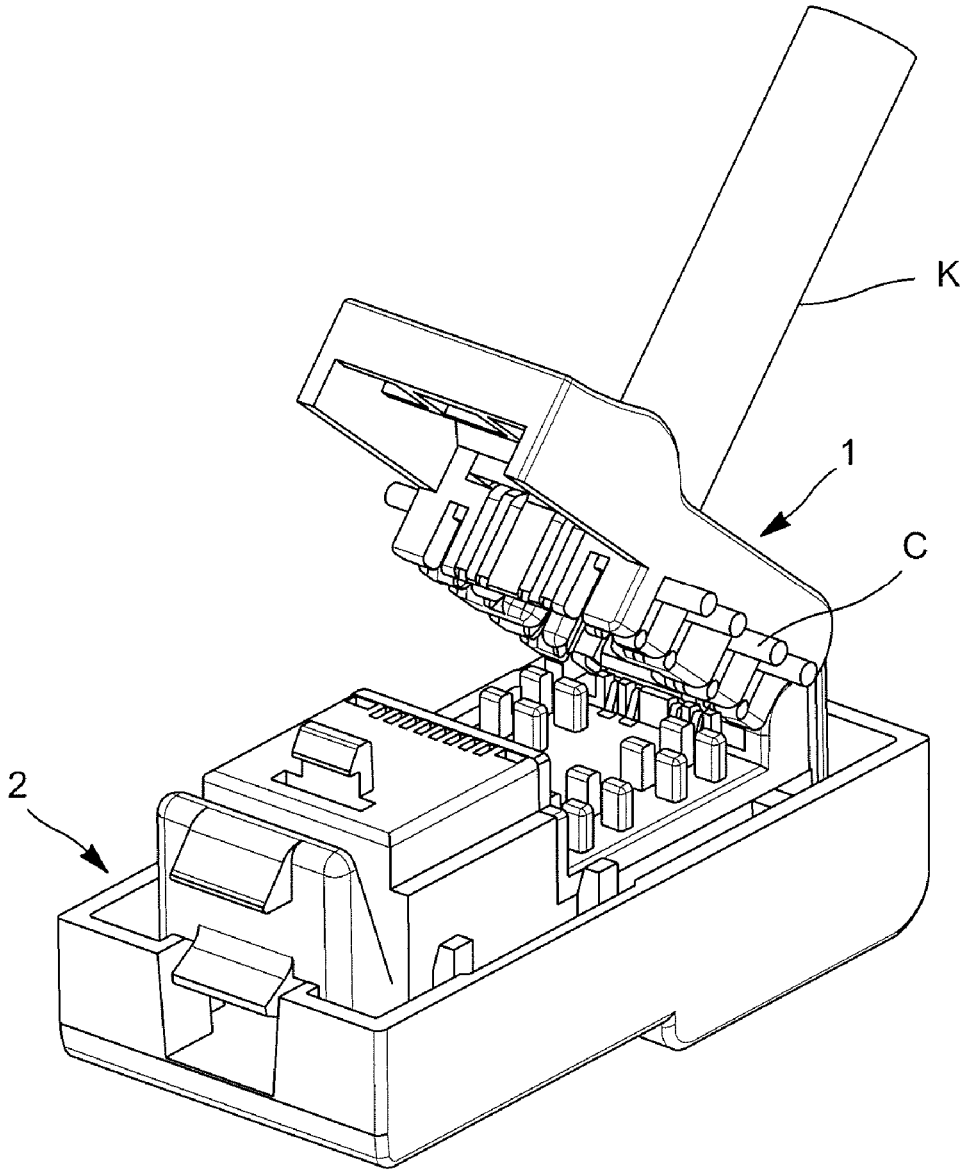
FIG. 10 is a perspective view of a connector according to the first embodiment of the invention, represented in the mounting phase after the comb and terminal block have been brought closer together.
Figure 11:
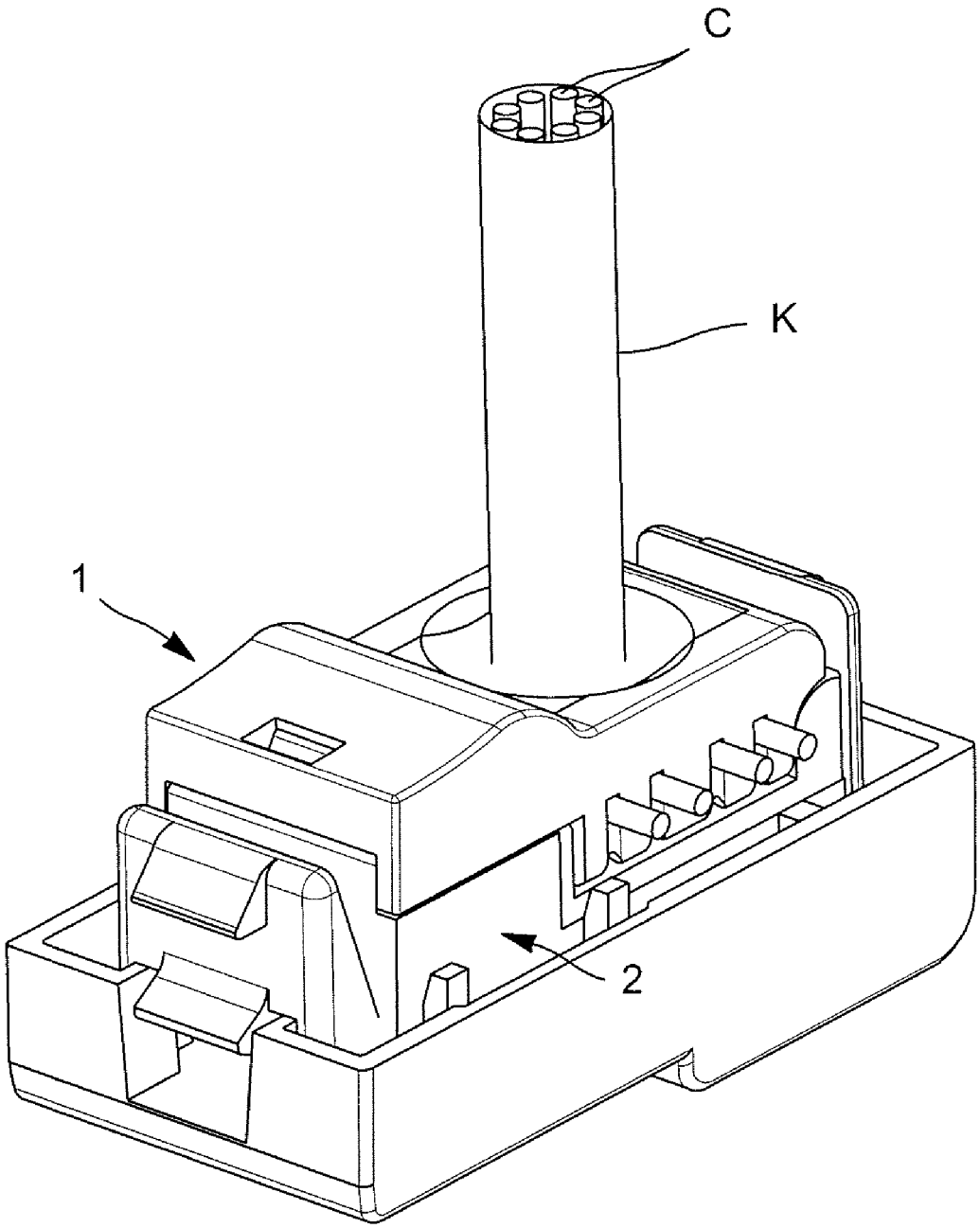
FIG. 11 is a perspective view of a connector according to the first embodiment of the invention, represented in the mounting phase after the assembly of the comb and the terminal block and before the sectioning of the conductors.

The connector may thus be assembled, at the end of the assembly phase, by inserting the tab 41 in the housing 43 (movement represented by the change from the position illustrated in FIG. 9 to the position illustrated in FIG. 10), and by pivoting the comb 1 with respect to the terminal block 2 by means of relative sliding of the respective guiding surfaces 100 and 200 thereof (movement represented by the change form the position illustrated in FIG. 10 to the position illustrated in FIG. 11), the tab 41, the housing 43, and the surfaces 100 and 200 acting as a pivot together.

To be able to ensure the mutual hold thereof, the comb 1 and the terminal block 2 also comprise, at a distance from said pivot, two other respective complementary retaining relief surfaces 42 and 44, which are locked elastically together in a reversible manner at the end of the connector mounting phase.

Figure 4:
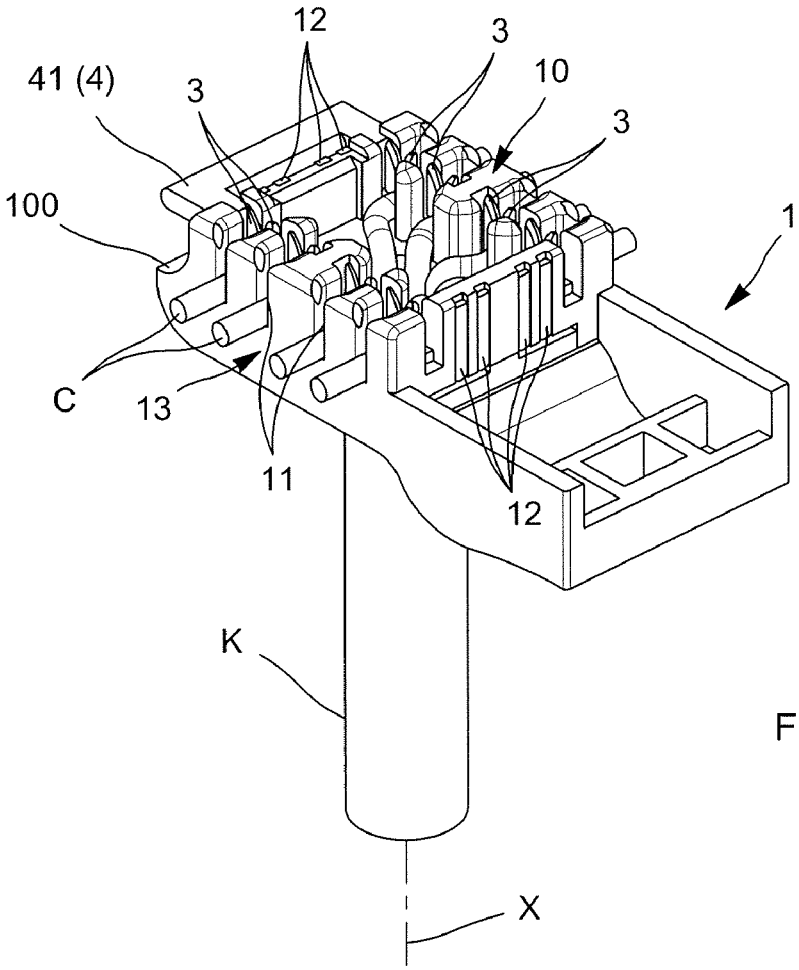
FIG. 4 is perspective view of the comb used in the connector in FIG. 1, said comb being illustrated before the sectioning of the conductors C, after a 90 degree rotation about the axis X in FIG. 1, and after a 180 degree rotation about the axis Y in FIG. 1.
Figure 5:
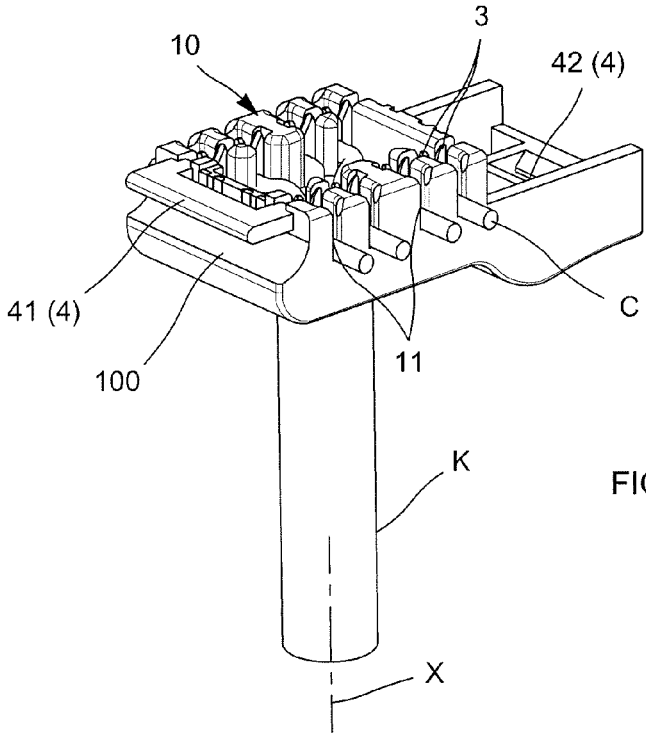
FIG. 5 is a perspective view of the comb illustrated in FIG. 4, observed after a 90 degree rotation about the axis X.
Figure 6:
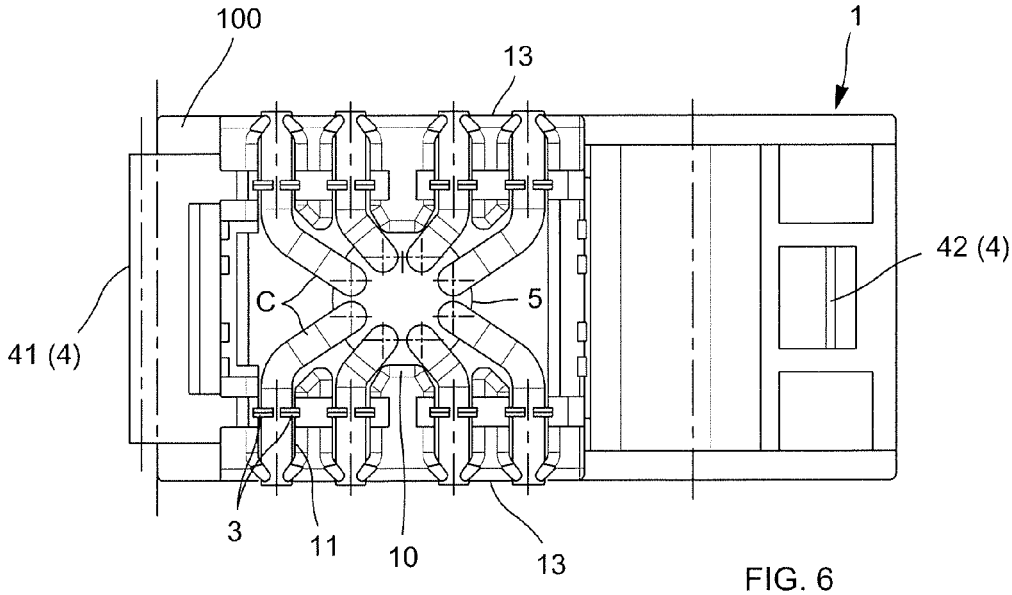
FIG. 6 is a larger-scale top view of the comb illustrated in FIG. 5.
Figure 7:
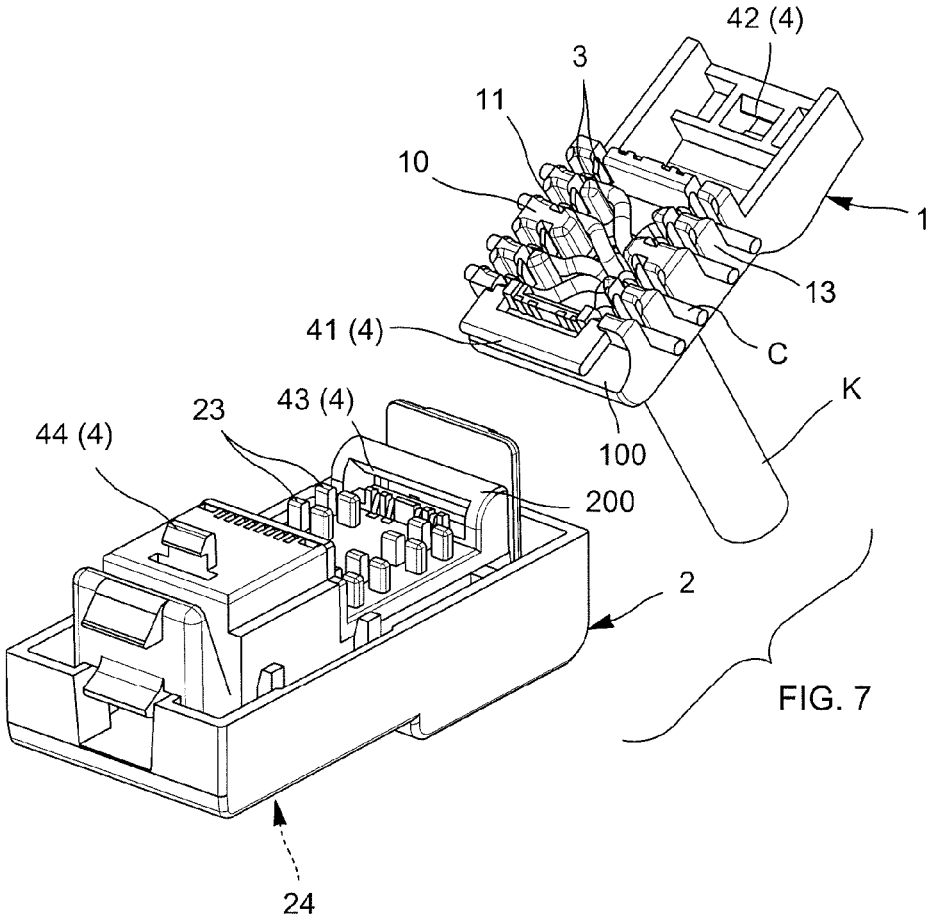
FIG. 7 is a perspective view of a connector according to the first embodiment of the invention, represented in the mounting phase, before the comb and terminal block are brought closer together.

As demonstrated in particularly in FIGS. 4 and 6, the notches 11 open onto free faces 13 of the comb 1, consisting of lateral faces, adjacent to the front face 10 of the comb 1 and perpendicular to said face 10.

By means of this arrangement, the insulated conductors C projected from said faces 13 may be readily sectioned after the connector has been mounted.

In one industrially optimized embodiment of the invention, the comb 1 and the terminal block 2, may be produced at least partially by molding a thermoplastic material.

The invention claimed is:

1. Connector to be mounted on a multiple conductor cable and comprising at least one comb, a connection terminal block, self-stripping electric contacts and assembling means, the comb being passed through by a central duct to allow the cable to pass along a longitudinal axis and displaying, on a first front face, notches arranged about the central duct and wherein each is designed to hold a corresponding insulated conductor of the cable, the terminal block having a plurality of metal contacts, being suitable for receiving a multiple conductor detachable plug, and comprising a second front face which, in the mounted configuration of the connector, is adjacent to the first front face, and an axial housing, opposite the second front face, serving as a receptacle for the detachable plug, each of the self-stripping electric contacts being suitable for receiving and stripping, during a connector mounting phase, a corresponding insulation conductor of the cable by means of a relative movement of said conductor and said contact, and the assembling means providing, in the mounted configuration of the connector, a reversible attachment of the comb and the terminal block on each other, characterized in that each self-stripping contact is on the first front face of the comb and associated with a corresponding notch to simultaneously enable the introduction of each insulated conductor into a notch and the engagement thereof in the self-stripping contact associated with said notch, and in that, at least in the mounted configuration of the connector, each self-stripping contact is connected electrically to a corresponding metal contact of the terminal block.

2. Connector according to claim 1, characterized in that the comb and the terminal block are detachable with respect to each other, in that the comb comprises a first set of transmission contacts each of which is connected to a corresponding self-stripping contact, in that the terminal block comprises a second set of transmission contacts each of which is connected to a corresponding metal contact of said terminal block, and in that, in the mounted configuration of the connector, each transmission contact of the first set is in electric contact with a corresponding transmission contact of the second set.

3. Connector according to claim 1, characterized in that it also comprises a flexible multiple conductor ribbon cable connecting the self-stripping contacts and the metal contacts individually.

4. Connector according to claim 1, characterized in that the second front face of the terminal block comprises a plurality of pins each of which, during the connector mounting phase, moves an insulated conductor to the rear of the corresponding notch, simultaneously triggering said relative movement of said conductor with respect to the self-stripping contact associated with said notch.

5. Connector according to claim 1, characterized in that the comb and the terminal block have cylindrical and complementary respective guiding surfaces, facing each other, and making it possible, by means of relative sliding, to guide the comb and the terminal block with respect to each other in the connector mounting phase.

6. Connector according to claim 5, characterized in that the comb and the terminal block comprise, on the side of the guiding surfaces, a first pair of complementary relief surfaces engaging with each other at the end of the connector assembly phase.

7. Connector according to claim 6, characterized in that the comb and the terminal block comprise, at a distance from the first pair of complementary relief surfaces, a second pair of respective complementary relief surfaces locking elastically with each other in a reversible manner at the end of the connector mounting phase.

8. Connector according to claim 1, characterized in that at least one of the members consisting of the comb and the terminal block is at least partially produced by molding a thermoplastic material.

* * * * *

UNITED STATES PATENT AND TRADEMARK OFFICE

CERTIFICATE OF CORRECTION

PATENT NO. : 8,011,949 B2
APPLICATION NO. : 12/522621
DATED : September 6, 2011
INVENTOR(S) : Foratier et al.

It is certified that error appears in the above-identified patent and that said Letters Patent is hereby corrected as shown below:

On the cover page of the patent, under item (30), entitled Foreign Application Priority Data, please replace the numerals "07 000240" with --07 00240--.

Signed and Sealed this
Fifteenth Day of November, 2011

David J. Kappos

David J. Kappos
*Director of the United States Patent and Trademark Office*